US008626006B2

(12) United States Patent
Masumura et al.

(10) Patent No.: US 8,626,006 B2
(45) Date of Patent: Jan. 7, 2014

(54) HEAT-RESPONSIVE SWITCH, FIXING DEVICE, AND IMAGE FORMING APPARATUS

(75) Inventors: Tomohiro Masumura, Kanagawa (JP); Katsuya Saito, Kanagawa (JP); Atsushi Hiroi, Kanagawa (JP); Toshihiko Mitsuhashi, Kanagawa (JP)

(73) Assignee: Fuji Xerox, Co., Ltd., Tokyo (JP)

( * ) Notice: Subject to any disclaimer, the term of this patent is extended or adjusted under 35 U.S.C. 154(b) by 149 days.

(21) Appl. No.: 13/267,349

(22) Filed: Oct. 6, 2011

(65) Prior Publication Data

US 2012/0251136 A1 Oct. 4, 2012

(30) Foreign Application Priority Data

Mar. 28, 2011 (JP) ..... 2011-070887

(51) Int. Cl.
*G03G 15/20* (2006.01)
*H01H 37/00* (2006.01)
*H01H 37/52* (2006.01)

(52) U.S. Cl.
USPC ..... 399/33; 337/298; 337/333; 337/354; 399/67; 399/320

(58) Field of Classification Search
USPC ..... 399/33, 67, 69, 320, 328, 329; 219/216; 337/298, 333, 343, 348, 354
See application file for complete search history.

(56) References Cited

U.S. PATENT DOCUMENTS

| | | | | | |
|---|---|---|---|---|---|
| 3,609,622 | A * | 9/1971 | Pringle et al. | 337/354 |
| 5,270,799 | A * | 12/1993 | Rose | 337/354 |
| 5,596,307 | A * | 1/1997 | Hayashi et al. | 337/298 |
| 5,929,742 | A * | 7/1999 | Short | 337/348 |
| 6,516,164 | B1 * | 2/2003 | Kawazu | 399/69 |
| 7,218,200 | B2 | 5/2007 | Hayashi et al. | |
| 2006/0082432 | A1 | 4/2006 | Hayashi et al. | |
| 2007/0098418 | A1 * | 5/2007 | Kang et al. | 399/33 |

FOREIGN PATENT DOCUMENTS

| | | |
|---|---|---|
| JP | A-09-198980 | 7/1997 |
| JP | A-2005-353390 | 12/2005 |

* cited by examiner

*Primary Examiner* — Sophia S Chen
(74) *Attorney, Agent, or Firm* — Oliff & Berridge, PLC

(57) ABSTRACT

A heat-responsive switch includes a case member, a deformation member deformed from a shape concave to an inside of the case member to a convex shape in response to a temperature variation, a first electrode having a first contact, a second electrode having a second contact and bringing the second contact into contact with the first contact with the first contact impelled to the deformation member, a first pressing member pressing the first electrode to separate the first contact from the second contact by having an end pressed by the deformation of the deformation member into the convex shape, and a second pressing member pressing the deformation member to restore the deformation member to the concave shape and pressing the second electrode to keep the first contact and the second contact separated by having the end pressed to the deformation member from an outside of the case member.

5 Claims, 14 Drawing Sheets

HEAT-RESPONSIVE SWITCH, FIXING DEVICE, AND IMAGE FORMING APPARATUS

CROSS-REFERENCE TO RELATED APPLICATIONS

This application is based on and claims priority under 35 USC 119 from Japanese Patent Application No. 2011-070887 filed Mar. 28, 2011.

BACKGROUND

Technical Field

The present invention relates to a heat-responsive switch, a fixing device, and an image forming apparatus.

SUMMARY

According to an aspect of the invention, there is provided a heat-responsive switch including: a case member; a deformation member that is supported by the case member in a shape concave to an inside of the case member and that is deformed in a shape convex to an inside of the case member in response to a temperature variation; a first electrode that has a first contact disposed inside the case member; a second electrode that has a second contact disposed between the deformation member and the first electrode and that brings the second contact into contact with the first contact in a state where the first contact is impelled to the deformation member; a first pressing member that is disposed to extend to the first electrode from between the deformation member and the second electrode and that presses the first electrode to separate the first contact from the second contact by having an end thereof pressed by the deformation of the deformation member into the convex shape; and a second pressing member of which an end protrudes from the case member in a state where the deformation member is deformed and that presses the deformation member to restore the deformation member to the concave shape and presses and elastically deforms the second electrode to keep the first contact and the second contact separated from each other by having the end pressed to the deformation member from an outside of the case member.

BRIEF DESCRIPTION OF THE DRAWINGS

Exemplary embodiments of the present invention will be described in detail based on the following figures, wherein:

FIG. 4A shows the thermostat when the temperature of a heating roll (in a case member of the fixing device) is within a predetermined temperature range (normal operating temperature) and FIG. 4B shows the thermostat when the temperature of the heating roll (in the case member of the fixing device) exceeds the predetermined temperature range (normal operating temperature);

FIG. 6A shows a state where a bimetal plate starts its restoration and FIG. 6B shows a state where the pin is kept pressed after the bimetal plate is restored;

DETAILED DESCRIPTION

Hereinafter, exemplary embodiments of the invention will be described with reference to the accompanying drawings.

Configuration of Image Forming Apparatus

Figure 1:
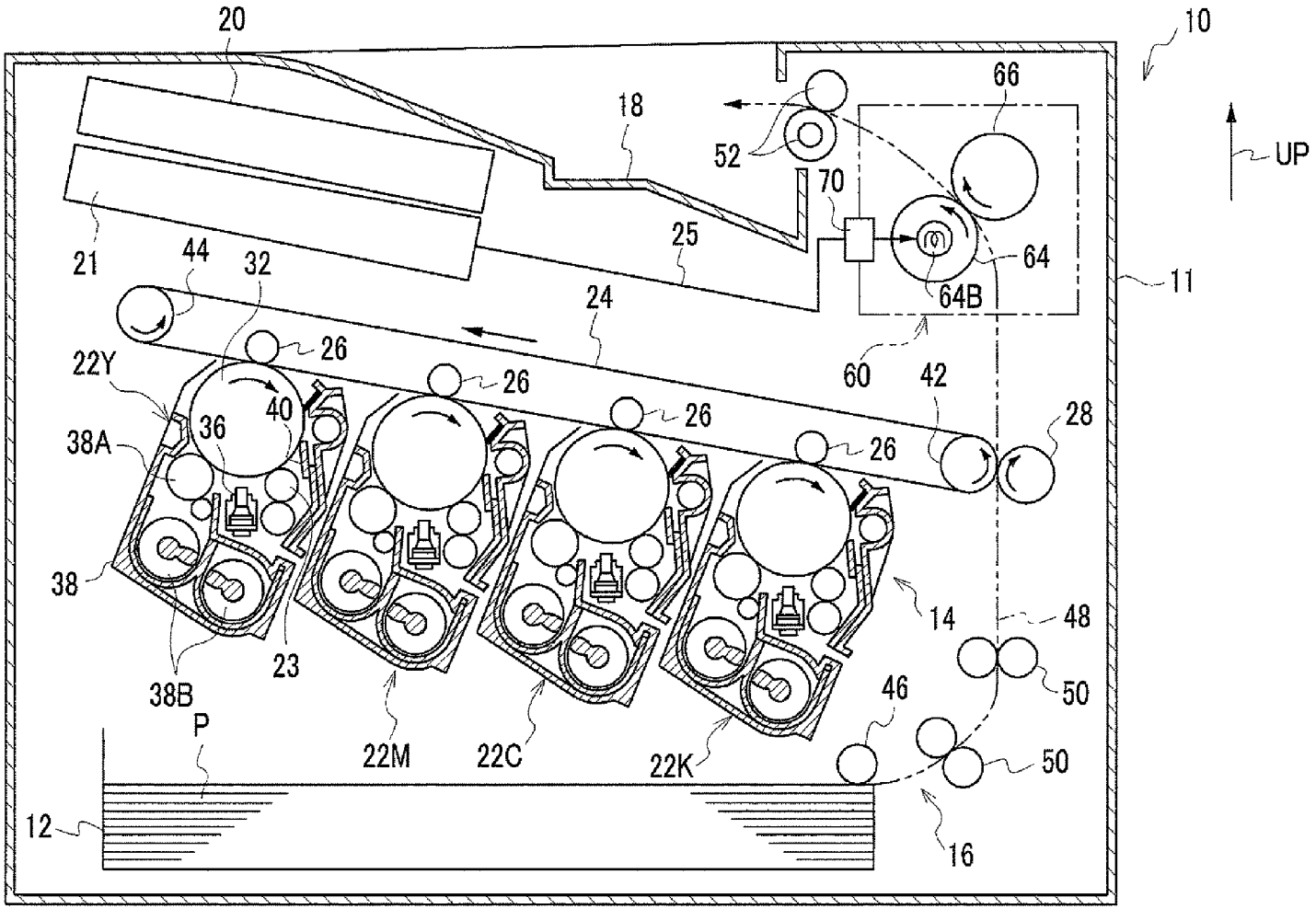
FIG. 1 is a diagram schematically illustrating the configuration of an image forming apparatus according to an exemplary embodiment.

The configuration of an image forming apparatus according to an exemplary embodiment of the invention will be described below. FIG. 1 is a diagram schematically illustrating the configuration of the image forming apparatus according to this exemplary embodiment. The arrow UP in the drawing represents the upside in the vertical direction.

As shown in FIG. 1, the image forming apparatus 10 includes an image forming apparatus body 11 having constituent elements therein. The image forming apparatus body 11 is provided with a sheet storing unit 12 storing recording media P such as sheets of paper, an image forming unit 14 forming an image on a recording medium P, a transport unit 16 transporting a recording medium P to the image forming unit 14 from the sheet storing unit 12, a control unit 20 controlling the elements of the image forming apparatus 10, and a power supply unit 21 supplying power to the elements of the image forming apparatus 10. A discharge unit 18 to which a recording medium P having an image formed thereon by the image forming unit 14 is discharged is disposed on the image forming apparatus body 11.

The image forming unit 14 includes image forming units 22Y, 22M, 22C, and 22K (hereinafter, referred to as 22Y to 22K) forming toner images of colors of yellow (Y), magenta (M), cyan (C), and black (K), an intermediate transfer belt 24 to which the toner images formed by the image forming units 22Y to 22K are transferred, first transfer rolls 26 transferring the toner images formed by the image forming units 22Y to 22K to the intermediate transfer belt 24, respectively, and a second transfer roll 28 transferring the toner images transferred to the intermediate transfer belt 24 by the first transfer roll 26 to a recording medium P from the intermediate transfer belt 24. The image forming unit 14 is not limited to the above-mentioned configuration, but may have another configuration, as long as it may form an image on a recording medium P.

The image forming units 22Y to 22K are arranged in parallel in the central portion in the vertical direction of the image forming apparatus 10 in a state where they are oblique about the horizontal direction. Each of the image forming units 22Y to 22K includes a photosensitive member 32 rotating in one direction (for example, in the clockwise direction in FIG. 1). The image forming units 22Y to 22K have the same configuration and thus the reference numerals and signs of the image forming units 22M, 22C, and 22K are not shown in FIG. 1.

Sequentially from the upstream in the rotating direction of each photosensitive member 32, a charging roll 23 as an example of the charging device charging the photosensitive member 32, an exposing device 36 exposing the photosensitive member 32 charged by the charging roll 23 to form an electrostatic latent image on the photosensitive member 32, a developing device 38 developing the electrostatic latent image formed on the photosensitive member 32 by the exposing device 36 to form a toner image, and a cleaning member 40 coming in contact with the photosensitive member 32 to remove toner remaining on the photosensitive member 32 are disposed around the photosensitive member 32.

The exposing device 36 forms an electrostatic latent image on the basis of an image signal sent from the control unit 20. An example of the image signal sent from the control unit 20 is an image signal which the control unit 20 acquires from an external device.

The developing device 38 includes a developer supply member 38A supplying a developer to the photosensitive member 32 and plural supply members 38B agitating and supplying the developer from the developer supply member 38A.

The intermediate transfer belt 24 is formed in a ring shape and is disposed above the image forming units 22Y to 22K. Winding rolls 42 and 44 on which the intermediate transfer belt 24 is wound is disposed in the inner periphery of the intermediate transfer belt 24. When one of the winding rolls 42 and 44 is rotationally driven, the intermediate transfer belt 24 circulates (rotates) in one direction (for example, in the counterclockwise direction in FIG. 1) while coming in contact with the photosensitive members 32. The winding roll 42 serves as a counter roll opposed to the second transfer roll 28.

Each first transfer roll 26 is opposed to the corresponding photosensitive member 32 with the intermediate transfer belt 24 interposed therebetween. A first transfer position where the toner image formed on the photosensitive member 32 is transferred to the intermediate transfer belt 24 is defined between the first transfer roll 26 and the photosensitive member 32.

The second transfer roll 28 is opposed to the winding roll 42 with the intermediate transfer belt 24 interposed therebetween. A second transfer position where the toner images transferred to the intermediate transfer belt 24 are transferred to a recording medium P is defined between the second transfer roll 28 and the winding roll 42.

The transport unit 16 includes a pickup roll 46 picking up a recording medium P stored in the sheet storing unit 12, a transport path 48 through which the recording medium P picked up by the pickup roll 46 is transported, and plural transport rolls 50 being disposed along the transport path 48 and transporting the recording medium P picked up the pickup roll 46 to the second transfer position.

A fixing device 60 fixing a toner image formed on the recording medium P by the image forming unit 14 to the recording medium P is disposed more downstream in the transport direction than the second transfer position. A discharge roll 52 discharging the recording medium P to which the toner image is fixed to the discharge unit 18 is disposed more downstream in the transport direction than the fixing device 60. The specific configuration of the fixing device 60 will be described later.

An image forming operation of forming an image on a recording medium P in the image forming apparatus 10 according to this exemplary embodiment will be described below.

In the image forming apparatus 10 according to this exemplary embodiment, the recording medium P picked up from the sheet storing unit 12 by the pickup roll 46 is transported to the second transfer position by the plural transport rolls 50.

On the other hand, in the image forming units 22Y to 22K, the photosensitive members 32 charged by the charging rolls 23 are exposed by the exposing devices 36 and electrostatic latent images are formed on the photosensitive members 32. The electrostatic latent images are developed by the developing devices 38 to form toner images on the photosensitive members 32, respectively. The toner images of the colors formed by the image forming units 22Y to 22K are superimposed on the intermediate transfer belt 24 at the first transfer positions to form a color image. The color image formed on the intermediate transfer belt 24 is transferred to the recording medium P at the second transfer position.

The recording medium P to which the toner image is transferred is transported to the fixing device 60 and the transferred toner image is fixed thereto by the fixing device 60. The recording medium P to which the toner image is fixed is discharged to the discharge unit 18 by the discharge roll 52. The series of image forming operations is performed in this way.

Configuration of Fixing Device

Figure 2:
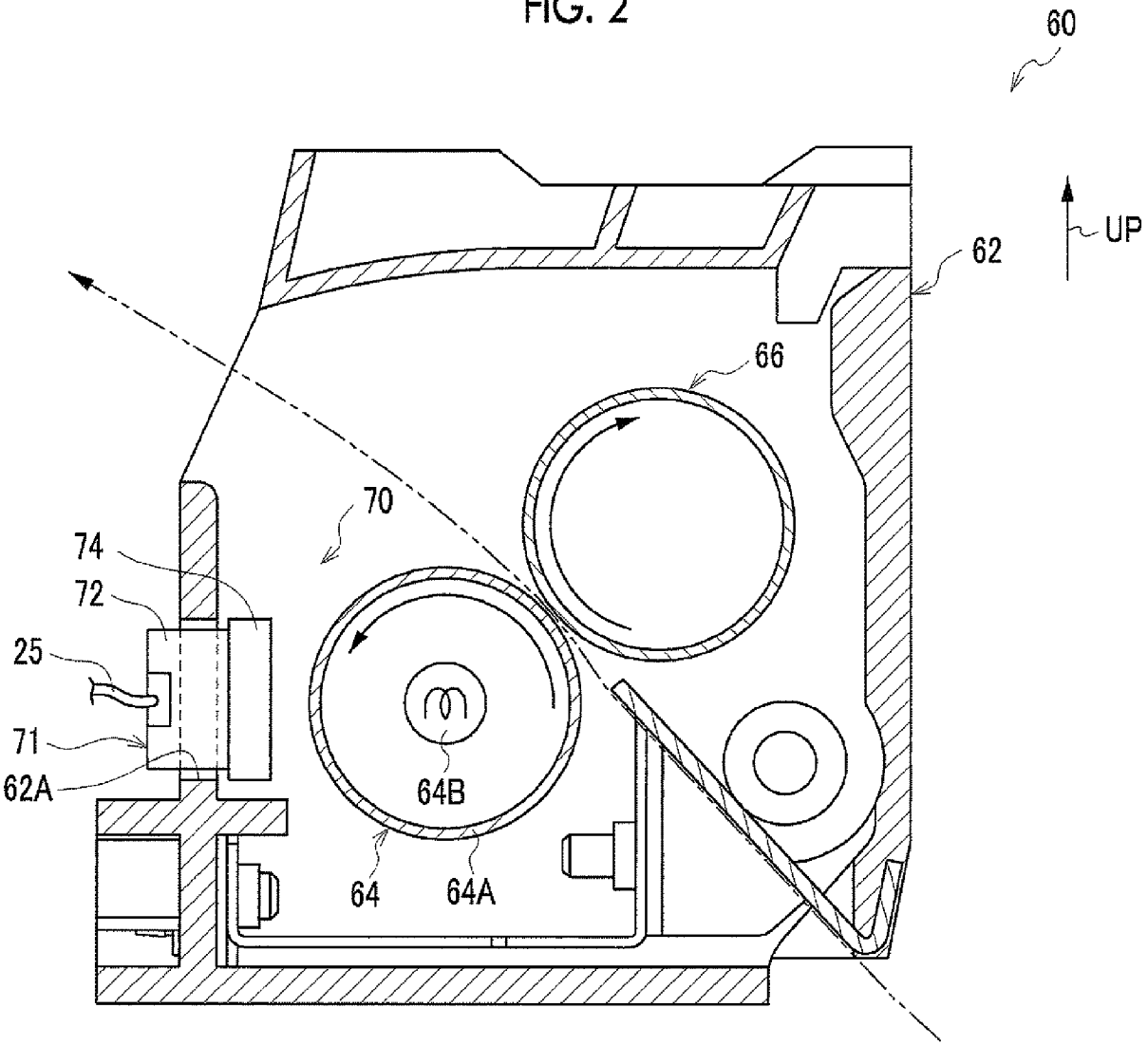
FIG. 2 is a sectional view illustrating the configuration of a fixing device according to the exemplary embodiment.

The configuration of the fixing device 60 according to this exemplary embodiment will be described below. FIG. 2 is a diagram schematically illustrating the configuration of the fixing device 60 according to this exemplary embodiment. The arrow UP in the drawing represents the upside in the vertical direction.

The fixing device 60 according to this exemplary embodiment is detachably attached to the image forming apparatus body 11 (see FIG. 1), as shown in FIG. 2, and includes a case member 62 having constituent elements therein. The case member 62 includes a heating roll 64 as an example of the heating member heating an image on a recording medium and a pressing belt 66 as an example of the pressing member therein.

The heating roll 64 includes a cylindrical member 64A having a cylindrical shape and a heat source 645 such as a halogen lamp disposed in the internal space of the cylindrical member 64A. The cylindrical member 64A is formed of a metal material such as aluminum and stainless steel.

The heat source 64B is electrically connected to the power supply unit 21 by an electrical circuit 25 as an example of the circuit supplying power to the heating roll 64 (the heat source 645). Accordingly, the heat source 64B is supplied with power from the power supply unit 21 via the electrical circuit 25.

The pressing belt 66 is constructed by a ring-like transport belt rotating with a recording medium P between the heating roll 64 and the pressing belt and pressing and transporting the recording medium P.

In the recording medium P pinched and transported between the heating roll 64 and the pressing belt 66, the toner is heated by the heating roll 64 and the toner is pressed by the pressing belt 66, whereby the image is fixed thereto in the contact area between the heating roll 64 and the pressing belt 66. In FIG. 2, the transport path along which the recording medium P is transported by the heating roll 64 and the pressing belt 66 is indicated by a two-dot chained line.

A thermostat 70 as an example of the heat-responsive switch is disposed in the case member 62 of the fixing device 60. Specifically, the thermostat 70 is disposed in the case member 62 of the fixing device 60 so that a bimetal plate 76 (see FIG. 3) to be described later faces the heating roll 64 and a predetermined gap is interposed between the heating roll 64 and the bimetal plate 76. The thermostat 70 is disposed in the electrical circuit 25 as shown in FIG. 1, and breaks the electrical circuit 25 to stop the supply of power from the power supply unit 21 to the heat source 64B when the temperature of the heating roll 64 (the inside of the chassis 62) reaches a predetermined temperature.

Specific Configuration of Thermostat

Figure 3:
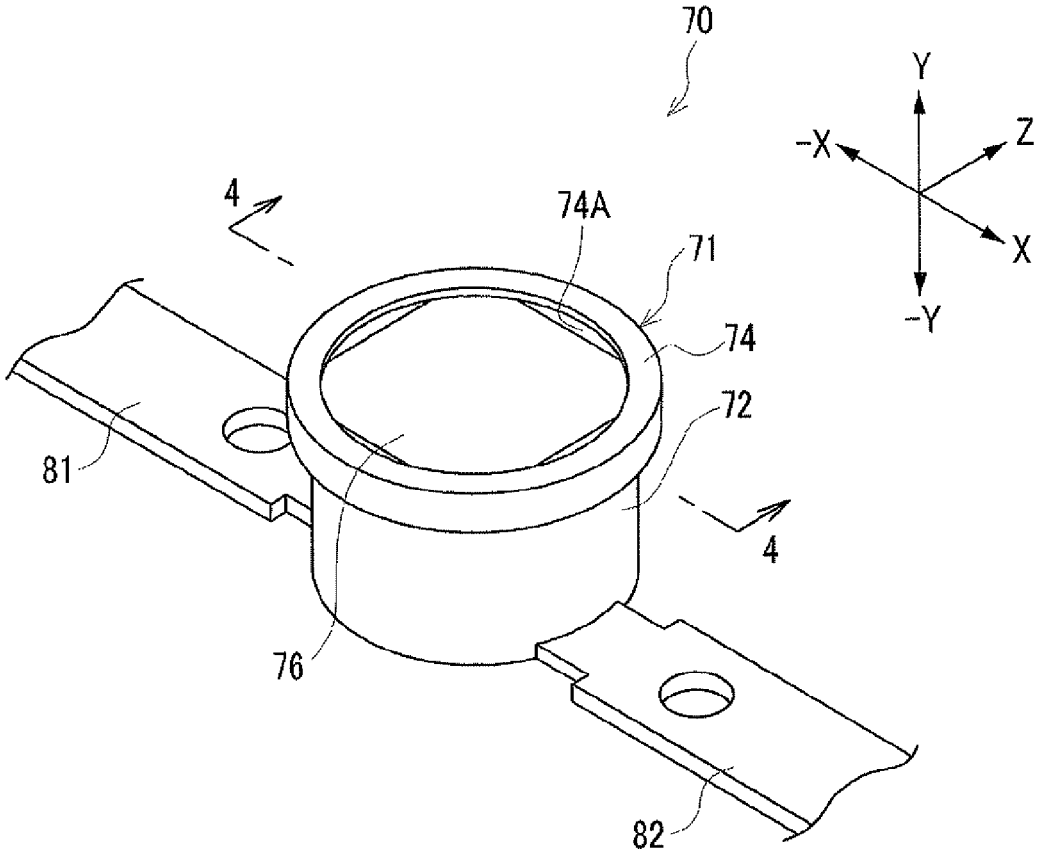
FIG. 3 is a diagram illustrating the appearance of a thermostat according to the exemplary embodiment.

The specific configuration of the thermostat 70 according to this exemplary embodiment will be described below. FIGS. 3 to 5 are diagrams schematically illustrating the configuration of the thermostat 70. In the following description, the X direction, the −X direction, the Y direction, the −Y direction, and the Z direction are the same as indicated by arrows in the drawings. The mark in which "x" is marked in "o" in the drawings means an arrow directed from the front side to the deep side.

As shown in FIGS. 2 and 3, the thermostat 70 according to this exemplary embodiment includes a device body 71 inserted into an insertion hole 62A formed in the case member 62 of the fixing device 60. The device body 71 is inserted into the insertion hole 62A and is thus mounted on the case member 62 of the fixing device 60.

Figure 4A:
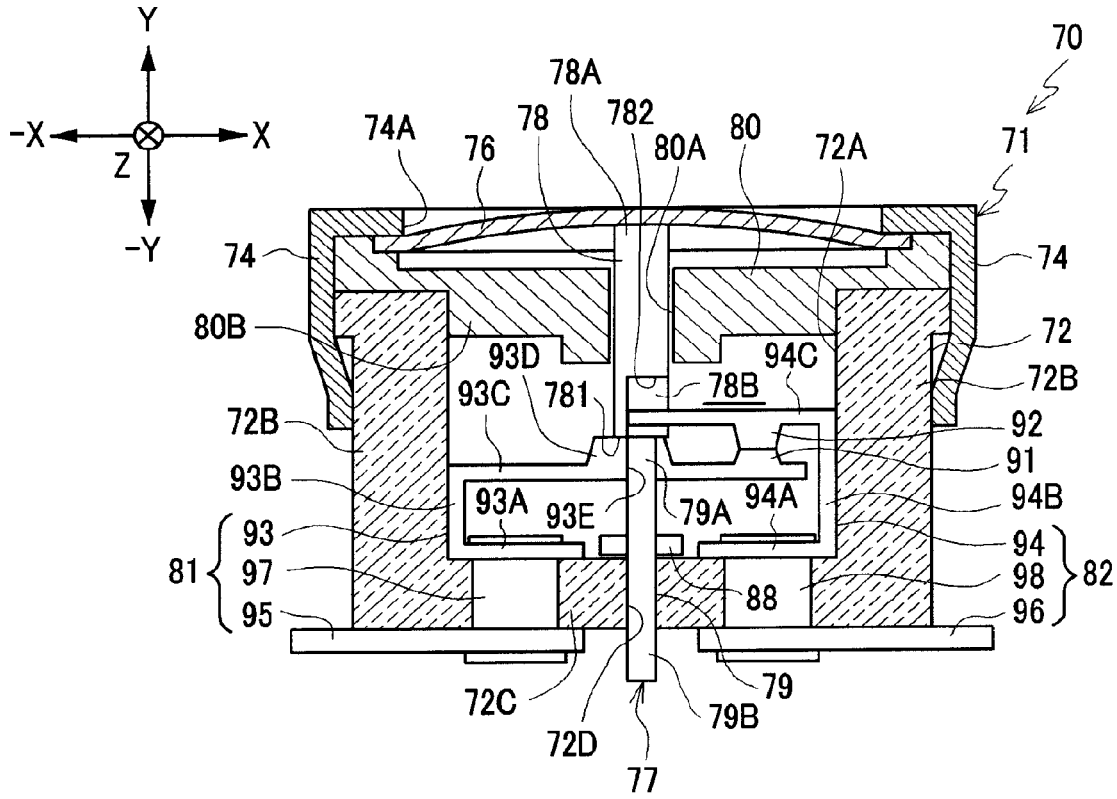
FIGS. 4A and 4B are sectional views taken along line 4-4 of FIG. 3, where
Figure 4B:
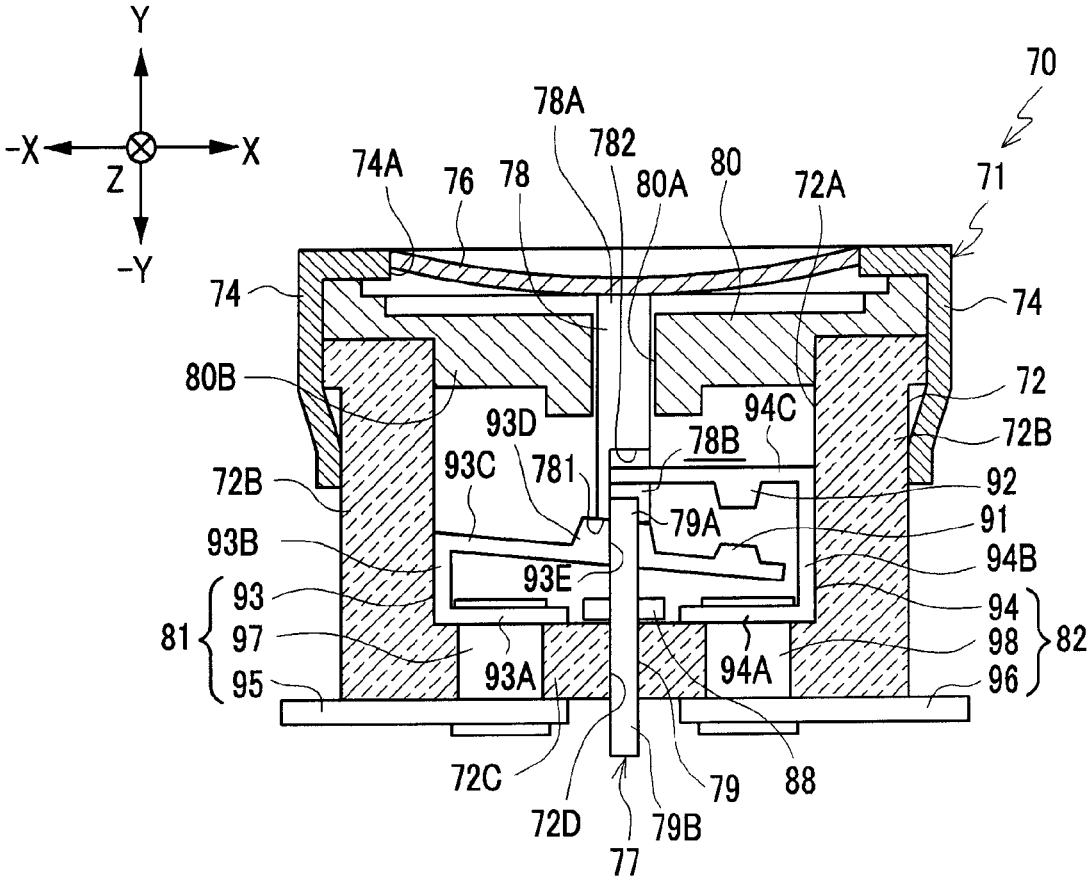
Figure 5:
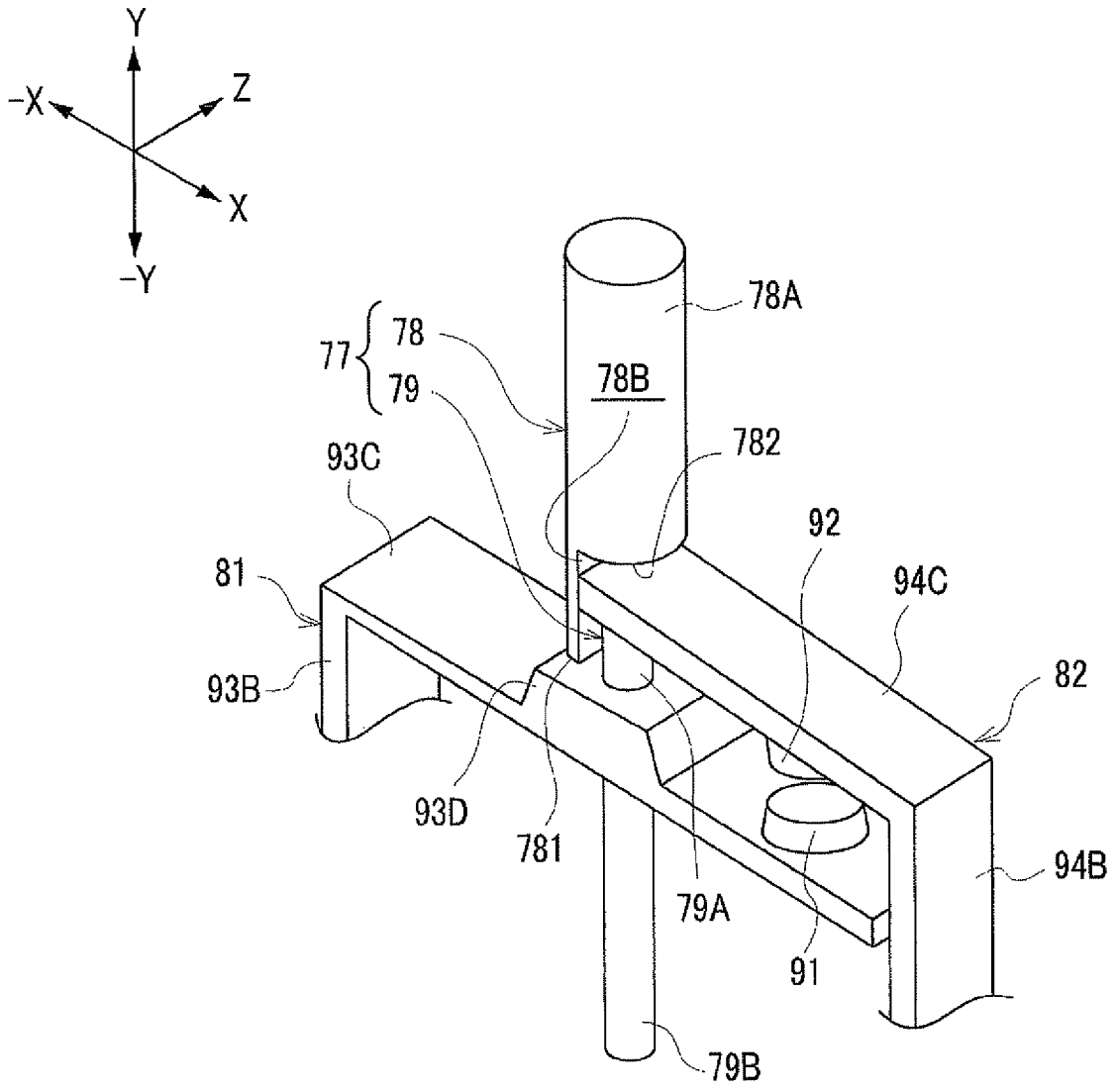
FIG. 5 is a perspective view schematically illustrating the configuration of a pin, a reset shaft, a first electrode, and a second electrode.

As shown in FIG. 3 and FIGS. 4A and 4B, the device body 71 of the thermostat 70 includes a cylindrical case member 72 having an opening 72A formed by opening an end (an end in the Y direction), a pin guide 80 disposed in the opening 72A of the case member 72 so as to guide a pin 78 to be described later in the axial direction (the Y direction) of the case member 72, a cap 74 as an example of the holding member disposed in the case member 72, and a first electrode 81 and a second electrode 82 disposed in the case member 72.

As shown in FIGS. 4A and 4B, a bottom wall 72C of the case member 72 has an insertion hole 72D formed in the central portion (at the center) in a plan view of the case member 72 (as seen from the −Y direction) so as to penetrate the bottom wall in the axial direction (the Y direction) of the case member 72 and the pin 78 to be described later is inserted into the insertion hole 72D. The case member 72 is formed of an insulating material. Examples of the insulating material include ceramics, phenol resin, and polyphenylsulfide. The shape and material of the case member 72 are not limited to the above-mentioned.

The pin guide 80 has a disc shape having an insertion hole 80A penetrating in the axial direction (the Y direction) of the case member 72, the pin 78 being inserted into the insertion hole. In the pin guide 80, a protruding portion 808 thereof protruding to the bottom wall 72C of the case member 72 (in the −Y direction) in the central portion in a plan view of the case member 72 (as seen from the −Y direction) is inserted into the opening 72A of the case member 72 and an outer peripheral portion thereof is interposed between the opened end (the end in the Y direction) of the case member 72 and the cap 74. In the pin guide 80, in the state where the pin 78 is inserted into the pin guide 80, the pin 78 may be allowed to move in the axial direction (in the Y direction) of the case member 72 along the insertion hole 80A, of the pin guide 80 and the movement thereof in the diameter direction (in the −X direction and the X direction) of the case member 72 is restricted by coming into contact with the inner wall of the pin guide 80.

A bimetal plate 76 as an example of the deformation member being deformed in response to a temperature variation is disposed between the pin guide 80 and the cap 74. The bimetal plate 76 is formed in a disc spring shape (by drawing) and is supported in the case member 72 in a shape concave to the inside of the case member 72 (the shape shown in FIG. 4A) by the cap 74 and the pin guide 80. The bimetal plate 76 is formed by bonding two kinds of metals having different linear expansion coefficients and is deformed (inverted) into a shape convex to the inside of the case member 72 (the shape shown in FIG. 4B) at a predetermined temperature.

As shown in FIG. 3, a circular opening 74A exposing the surface of the bimetal plate 76 to the outside is formed in the central portion in a plan view of the cap 74 (as seen from the −Y direction). The cap 74 is swaged to the case member 72 to be fixed to the case member 72.

As shown in FIGS. 4A and 4B, the first electrode 81 includes a movable electrode 93 being disposed inside the case member 72 and having a U shape in a side view (as seen from the Z direction), a terminal 95 disposed on the outer surface of the bottom wall 72C of the case member 72, and a rivet 97 penetrating the bottom wall 72C of the case member 72 and electrically connecting the terminal 95 to the movable electrode 93.

The movable electrode 93 is constructed by bending a plate-like electrode having heat resistance, conductivity, and elasticity (spring property) in a U shape. The movable electrode 93 includes a first portion 93A disposed on the inner surface of the bottom wall 72C of the case member 72, a second portion 93B disposed on the inner surface of a side wall 72B of the case member 72 and extending to an end of the first portion 93A close to the side wall 72B (in the −X direction) towards the bimetal plate 76 (in the Y direction), and a third portion 93C extending from an end of the second portion 93B close to the bimetal plate 76 (in the Y direction) in the diameter direction (in the X direction) of the case member 72.

The movable electrode 93 is electrically connected to the rivet 97 in the first portion 93A. The third portion 93C of the movable electrode 93 has a length in the diameter direction (in the X direction) of the case member 72 and a middle portion in the length direction passes through the central portion in a plan view of the case member 72 (as seen from the −Y direction). A contact portion 93D protruding towards the bimetal plate 76 and coming in contact with a first surface 781 of the pin 78 to be described later is formed in the middle portion in the length direction. An insertion hole 93E which penetrates the movable electrode 93 in the thickness direction thereof and into which a reset shaft 79 to be described later is formed in the middle portion in the length direction. A first contact 91 protruding towards the bimetal plate 76 and coming in contact with a second contact 92 to be described later is formed at a distal end (an end in the X direction) of the third portion 93C.

In the movable electrode 93, the first contact 91 is impelled towards the bimetal plate 76 (in the Y direction) in a state where it is in contact with the second contact 92 to be described later. Specifically, the movable electrode 93 is formed of a leaf spring and the first contact 91 is impelled towards the bimetal plate 76 (in the Y direction) with its own elastic force.

As shown in FIGS. 4A and 4B, the second electrode 82 includes a movable electrode 94 disposed in the case member 72 and formed in a U shape opposite to the movable electrode 93 in a side view (as seen from the Z direction), a terminal 96 disposed on the outer surface of the bottom wall 72C of the case member 72 on the opposite side (the side in the X direction) of the terminal 95 about the center in the diameter direction of the case member 72, a rivet 98 penetrating the bottom wall 72C of the case member 72 and electrically connecting the movable electrode 94 to the terminal 96 on the opposite side (a side in the X direction) of the rivet 97 about the center in the diameter direction of the case member 72.

The movable electrode 94 is formed by bending a plate-like electrode having heat resistance, conductivity, and elasticity (spring property) in a U shape. The movable electrode 94 includes a first portion 94A disposed on the inner surface of the bottom wall 72C of the case member 72, a second portion 94B being disposed on the inner surface of the side wall 72B of the case member 72 and extending from an end of the first portion 94A facing the side wall 72B (an end in the X direction) towards the bimetal plate 76 (in the Y direction) more than the third portion 93C of the movable electrode 93, and a third portion 940 extending from an end of the second portion 94B facing the bimetal plate 76 (in the Y direction) in the diameter direction (in the −X direction) of the case member 72.

The movable electrode 94 is electrically connected to the rivet 98 in the first portion 94A. The third portion 940 of the movable electrode 94 has a length in the diameter direction (in the −X direction) of the case member 72. The distal end (an end in the −X direction) of the third portion 94C is disposed in a cutout 78B of the pin 78 to be described later. A second contact 92 protruding towards the first electrode 81 (in the −Y direction) is formed in the middle portion in the length direction of the third portion 94C.

The second contact 92 is directed to the first contact 91 (in the −Y direction) and comes in contact with the first contact 91 in the state where the first contact 91 is impelled towards the bimetal plate 76. Accordingly, the first contact 91 is separated from the second contact 92 when a countervailing force to the side (in the −Y direction) to which the first contact 91 is separated from the second contact 92 acts on the first electrode 81 against the impelling force, and the first contact 91 comes into contact with the second contact 92 when the countervailing force does not act.

A member formed of, for example, stainless steel, copper, or phosphor bronze or a member obtained by plating the member with tin, nickel, silver, gold, or the like is used as the member (electrode) constituting the movable electrode 93 and the movable electrode 94 having heat resistance, conductivity, and elasticity (spring property).

The thermostat 70 includes a pressing member 77 disposed to extend to the first electrode 81 from between the bimetal plate 76 and the second electrode 82. The pressing member 77 includes a pin 78 as an example of the first pressing member disposed between the first electrode 81 and the bimetal plate 76 and a reset shaft 79 as an example of the second pressing member disposed to extend from an end of the pin 78 facing the first electrode 81 (an end in the −Y direction) to the outside of the case member 72 towards the opposite side (in the −Y direction) of the bimetal plate 76.

The pin 78 has a length in the axial direction (in the Y direction) of the case member 72 and has a rod shape (for example, a cylinder shape). The pin 78 is inserted into the insertion hole 80A of the pin guide 80 in the central portion (at the center) in a plan view of the case member 72 (as seen from the −Y direction) so as to be movable in the axial direction (in the −Y direction) of the case member 72.

As shown in FIG. 5 and FIGS. 4A and 4B, a cutout 78B is formed in a part of an end of the pin 78 (an end in the −Y direction) close to the first electrode 81. Accordingly, in the pin 78, a first surface 781 facing the contact portion 93D of the first electrode 81 (in the −Y direction) is formed at the end (the end in the −Y direction) close to the first electrode 81, and a second surface 782 facing the third portion 94C of the second electrode 82 (in the −Y direction) is formed on a side closer to the bimetal plate 76 (in the Y direction) than the first surface 781.

In the pin 78, an end 78A, which is close to the bimetal 76, as a portion to be pressed towards the first electrode 81 (in the −Y direction) by the bimetal plate 76 deformed in a shape (the state shown in FIG. 4B) convex to the inside of the case member 72 is disposed between the bimetal plate 76 and the pin guide 80. The end 78A close to the bimetal plate 76 also serves as a portion pressing the bimetal plate 76 by causing the second surface 782 to be pressed by the reset shaft 79 at the time of restoring the bimetal plate 76.

The first surface 781 of the pin 78 serves as a portion pressing the first electrode 81 when the end 782*k* close to the bimetal plate 76 is pressed to move towards the first electrode 81 (in the −Y direction) by the deformation of the bimetal plate 76 into the convex shape (the state shown in FIG. 4B). The second surface 782 of the pin 78 serves as a portion to be pressed by the reset shaft 79 with the second electrode 82 at the time of restoring the bimetal plate 76.

In the pin 78, the second electrode 82 and the reset shaft 79 are made to move relative to the pin 78 in the space of the cutout 78B so as not to press the second electrode 82 and the reset shaft 79 with the pin 78, when the pin 78 moves towards the first electrode 81 (in the −Y direction).

The reset shaft 79 has a length in the axial direction (in the Y direction) of the case member 72 and has a rod shape (for example, a cylinder shape) having a smaller width (a diameter) in the X direction than that of the pin 78. The reset shaft 79 is inserted into the insertion hole 72D of the bottom wall 72C of the case member 72 and the insertion hole 93E of the first electrode 81 so as to be movable in the axial direction (in the −Y direction) of the case member 72 in the central portion (at the center) in a plan view of the case member 72 (as seen from the −Y direction).

A stopper 88 preventing the reset shaft 79 from departing from the case member 72 is disposed at a position of the reset shaft 79 between the bottom wall 72C of the case member 72 and the first electrode 81. The stopper 88 is disposed at a position where it does not press the first electrode 81 towards the second electrode 82 (in the Y direction) when the reset shaft 79 is pressed towards the bimetal plate 76 from the outside of the case member 72 at the time of restoring the bimetal plate 76.

In the reset shaft 79, the protruding portion 79B (the end in the −Y direction) protruding from the bottom wall 72C of the case member 72 to the outside (in the −Y direction) serves as a portion to be pressed towards the bimetal plate 76 from the outside of the case member 72 at the time of restoring the bimetal plate 76.

In the reset shaft 79, the end 79A (the end in the Y direction) close to the bimetal plate 76 serves as a portion pressing the second electrode 82 to hold the state where the first contact 91 and the second contact 92 are separated from each other when the protruding portion (the end in the −Y direction) 79B is pressed toward the bimetal plate 76 (in the Y direction) from the outside of the case member 72 and pressing the bimetal plate 76 to restore the bimetal plate 76 into the concave portion by pressing the second surface 782 of the pin 78 with the second electrode 82 interposed therebetween. The pin 78 and the reset shaft 79 are formed of an insulating material, similarly to the case member 72.

As described above, in this exemplary embodiment, the pressing member 77 is functionally divided into the pin 78 as an example of the first pressing member and the reset shaft 79 as an example of the second pressing member.

Operation

The operation in the exemplary embodiment will be described below.

According to the configuration of this exemplary embodiment, when the temperature of the heating roll 64 (the internal temperature of the case member 62 of the fixing device 60) is in a predetermined temperature range (a range of normal operating temperature), the bimetal plate 76 has a concave shape which is concave to the inside of the case member 72, as shown in FIG. 4A.

In this case, the countervailing force against the impelling force does not act on the first electrode 81 and the first contact 91 comes in contact with the second contact 92 of the second electrode 82. Accordingly, the electrical circuit 25 is not broken and the heat source 64B is supplied with power from the power supply unit 21 via the electrical circuit 25.

In the fixing device 60, when the temperature of the heating roll 64 (the internal temperature of the case member 62 of the fixing device 60) is higher than a predetermined temperature (the normal operating temperature), the bimetal plate 76 is deformed (inverted) into a shape convex to the inside of the case member 72, as shown in FIG. 4B.

When the bimetal 76 is deformed (inverted) into the shape convex to the inside of the case member 72, the end 78A of the pin 78 close to the bimetal plate 76 is pressed towards the first electrode 81 (in the −Y direction) by the bimetal plate 76 and moves towards the first electrode 81. Accordingly, the first surface 781 of the pin 78 presses the first electrode 81 towards the bottom wall 72C (in the −Y direction) of the case member 72 against the impelling force, the first contact 91 of the first electrode 81 moves towards the bottom wall 72C of the case member 72, and thus the second contact 92 and the first contact 91 are separated from each other. Accordingly, the electrical circuit 25 is broken and the supply of power to the heat source 64B from the power supply unit 21 is stopped.

When the pin 78 moves towards the first electrode 81 (in the −Y direction), the second electrode 82 and the reset shaft 79 are not pressed by the pin 78 and do not move, because the cutout 78B is formed in the pin 78.

Figure 6A:
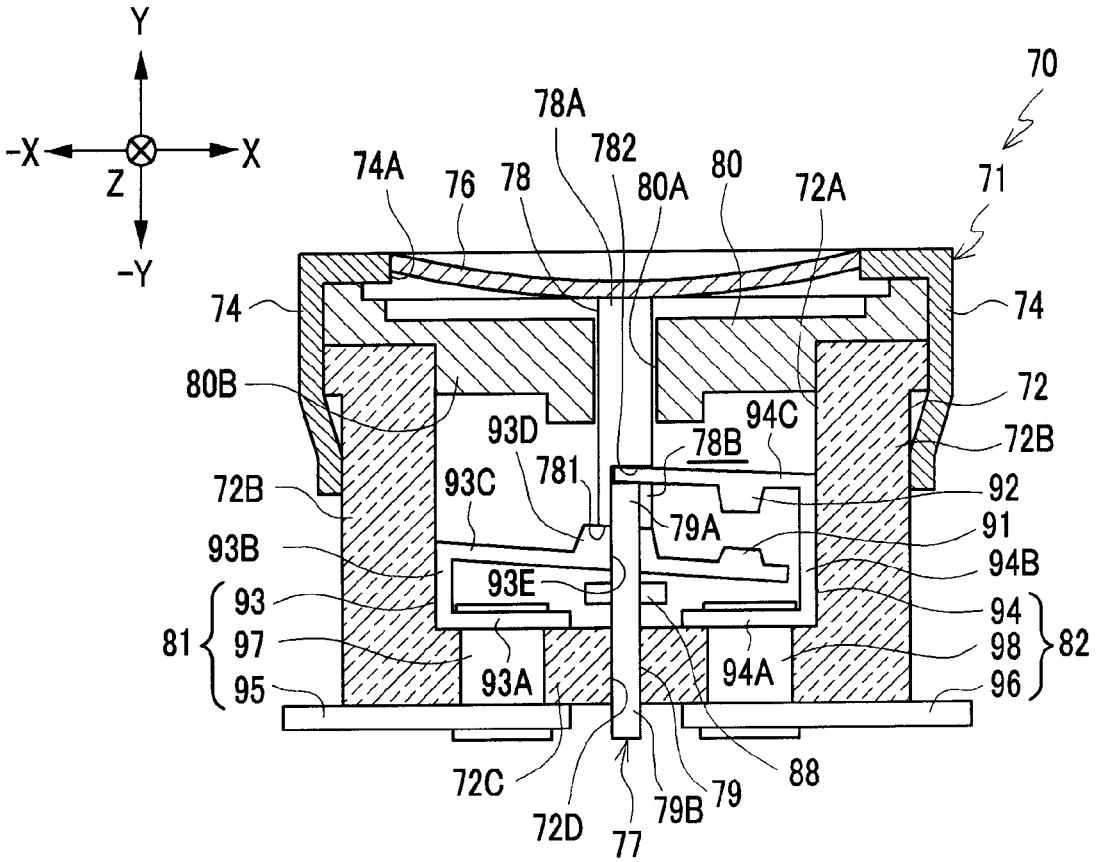
FIGS. 6A and 6B are sectional views taken along line 4-4 of FIG. 3, where

As shown in FIG. 6A, when the protruding portion 79B (the end in the −Y direction) of the reset shaft 79 is pressed towards the bimetal plate 76 (in the Y direction) from the outside of the case member 72 (from the outside of the bottom wall 72C (from the −Y direction)) at the time of restoring the bimetal plate 76, the second electrode 82 is pressed by the end of the reset shaft 79 close to the bimetal plate 76 (the end in the Y direction) and is pressed to the second surface 782 of the pin 78.

Figure 6B:
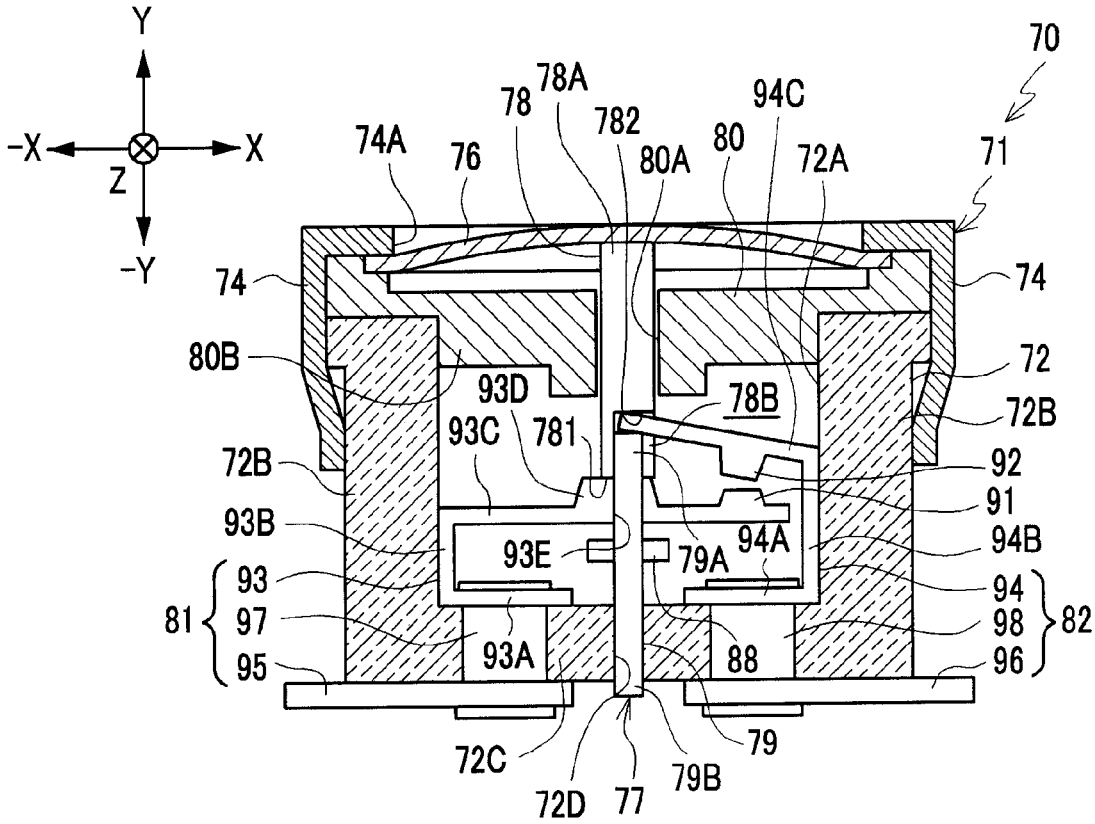

As shown in FIG. 6B, when the protruding portion (the end in the −Y direction) 79B of the reset shaft 79 is pressed towards the bimetal plate 76 (in the Y direction) from the outside of the case member 72 (the outside of the bottom wall 72C (from the −Y direction)), the end 79A of the reset shaft 79 close to the bimetal plate 76 (the end in the Y direction) presses the second surface 782 of the pin 78 towards the bimetal plate 76 (in the Y direction) with the second electrode 82 interposed therebetween. Accordingly, the pin 78 moves to the bimetal plate 76 (in the Y direction), and the bimetal plate 76 is pressed and restored into the concave shape by the end 78A of the pin 78 close to the bimetal plate 76.

At this time, the first electrode 81 pressed to the bottom wall 72C (in the −Y direction) by the first surface 781 of the pin 78 is restored to the original state with the movement of the pin 78 towards the bimetal plate 76 (in the Y direction) and the first contact 91 moves towards the bimetal plate 76 (in the Y direction). However, the second electrode 82 is also pressed towards the bimetal plate 76 (in the Y direction) by the reset shaft 79 and is elastically deformed, and thus the second contact 92 moves towards the bimetal plate 76 (in the Y direction). Accordingly, the state where the second contact 92 is separated from the first contact 91 is maintained.

When a pressing force (an external force) does not act on the reset shaft 79 pressed towards the bimetal plate 76 (in the Y direction), the second electrode 82 elastically deformed is restored to the original state with its own elastic force and the second contact 92 comes into contact with the first contact 91 (see FIG. 4A).

On the other hand, when the reset shaft 79 is pressed towards the bimetal plate 76 (in the Y direction), the second electrode 82 is maintained in the elastically-deformed state and the state where the second contact 92 and the first contact 91 are separated from each other is maintained. Accordingly, the electrical circuit 25 is broken and the supply of power to the heat source 64B from the power supply unit 21 is continuously stopped.

In this way, in this exemplary embodiment, with a simple configuration such as two members of the pin 78 and the reset shaft 79, when the reset shaft 79 is maintained in the state where it is pressed towards the bimetal plate 76 (the Y direction), the second electrode 82 is maintained in the elastically-deformed state and the state where the second contact 92 and the first contact 91 are separated from each other is maintained.

In this exemplary embodiment, the pressing member 77 includes two members of the pin 78 as an example of the first pressing member and the reset shaft 79 as an example of the second pressing member. However, the pressing member 77 may be constructed by a single member into which the first pressing member and the second pressing member are incorporated. Modifications of the pressing member 77 constructed by a single member will be described below.

First Modification

Figure 7:
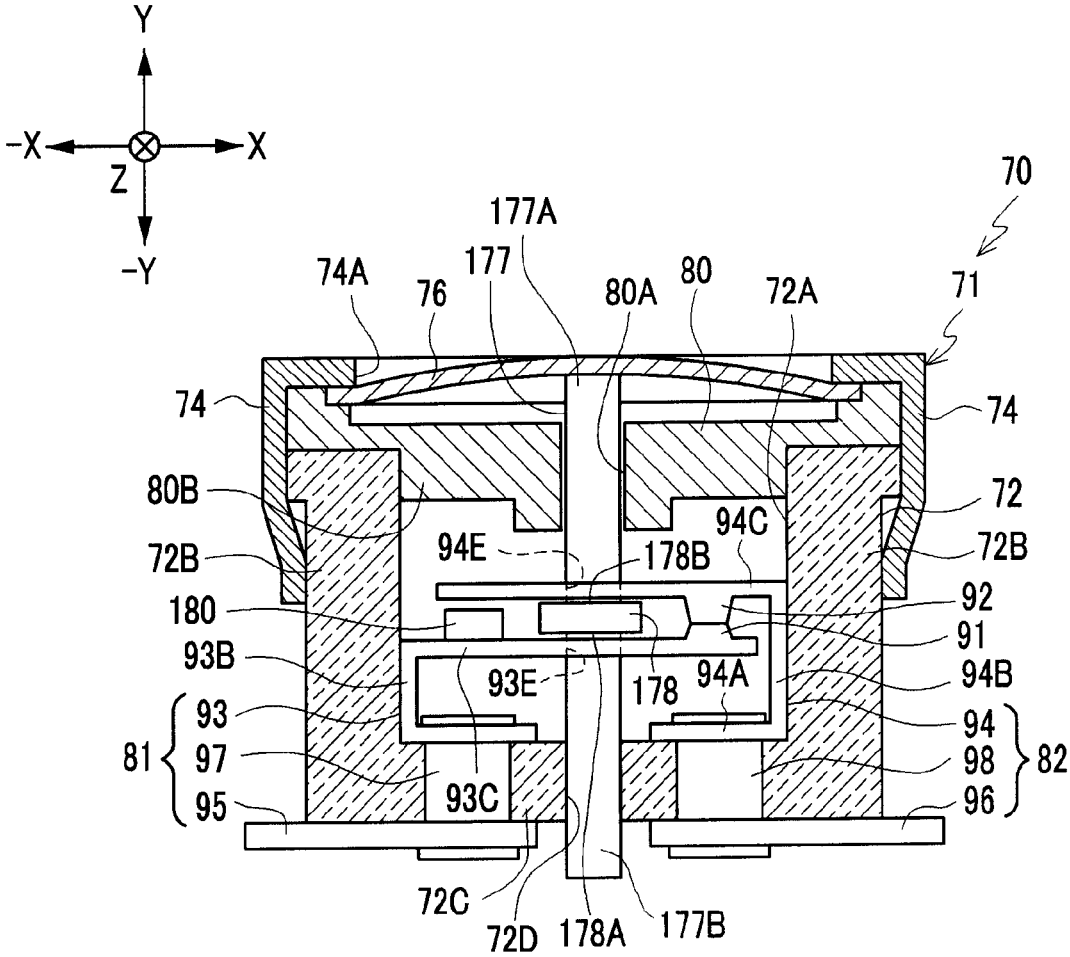
FIG. 7 is a diagram schematically illustrating the configuration of a thermostat according to a first modification of the invention.
Figure 8:
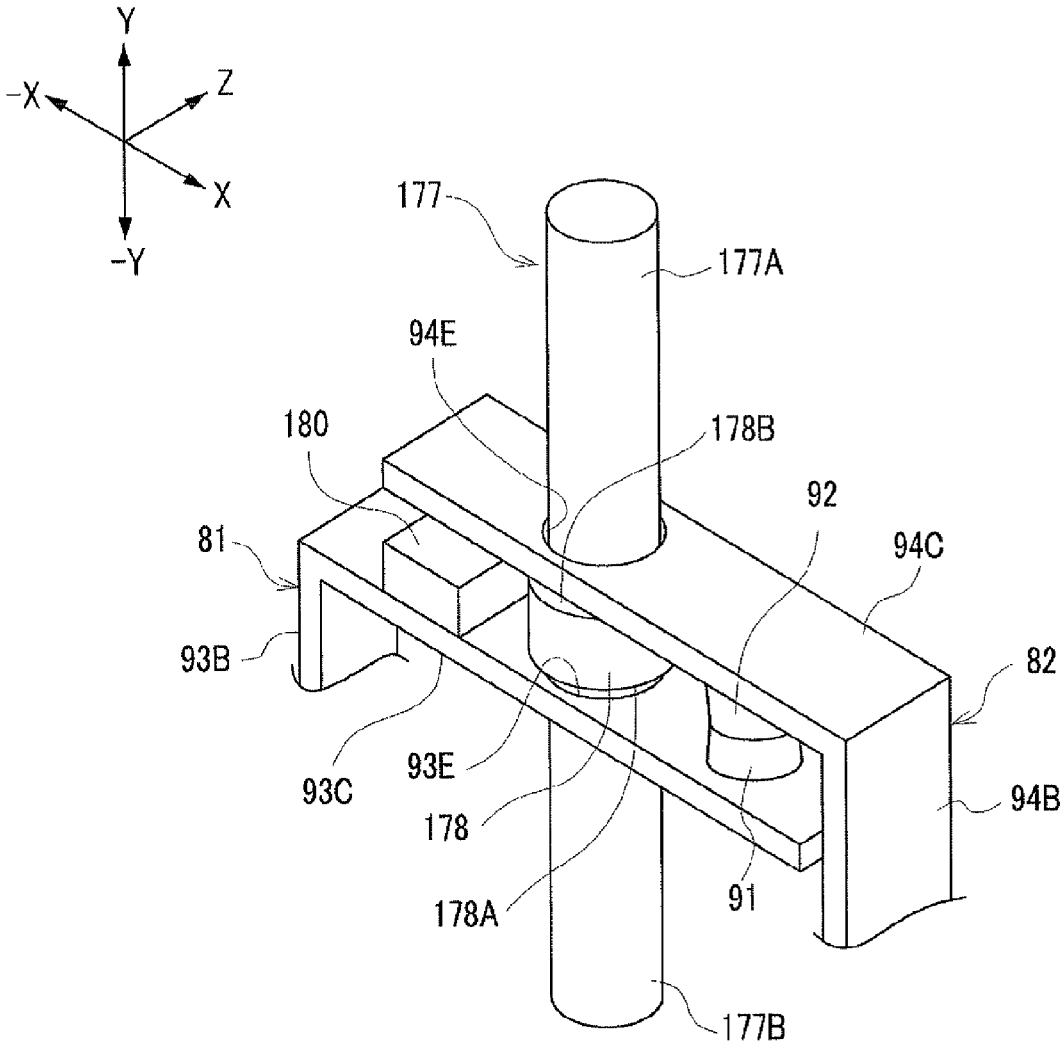
FIG. 8 is a perspective view schematically illustrating the configuration of a pressing member, a first electrode, and a second electrode in the first modification.

FIGS. 7 and 8 are diagrams illustrating the configuration of a first modification. Elements having the same functions as in the above-mentioned exemplary embodiment are referenced by the same reference numerals and signs and the description thereof will not be repeated.

In the configuration of the first modification, as shown in FIG. 7, the third portion 94C of the second electrode 82 is longer in the diameter direction (in the −X direction) of the case member 72 than that in the above-mentioned exemplary embodiment, the middle portion in the length direction passes through the central portion in a plan view of the case member 72 (as seen from the −Y direction), and the distal end (the end in the −X direction) thereof is disposed on the opposite side (on the side in the −X direction) of the second contact 92 about the pressing member 177.

As shown in FIGS. 7 and 8, an insertion hole 94E which penetrates the movable electrode 93 in the thickness direction thereof and into which the pressing member 177 is inserted is formed in the middle portion in the length direction of the third portion 94C. In the case member 72, a spacer member 180 holding the space between the first electrode 81 and the second electrode 82 is disposed between the distal end (the end in the −X direction) of the third portion 94C and the proximal end (the end in the −X direction) of the third portion 93C of the first electrode 81. When a necessary space is kept between the first electrode 81 and the second electrode 82, the spacer member 180 may not be provided.

The pressing member 177 according to the first modification has a length in the axial direction (in the Y direction) of the case member 72 and has a rod shape (for example, a cylinder shape). The pressing member 177 is inserted into the insertion hole 80A of the pin guide 80, the insertion hole 93E of the first electrode 81, the insertion hole 94E of the second electrode 82, and the insertion hole 72D of the bottom wall 72C of the case member 72 so as to be movable in the axial direction (in the −Y direction) of the case member 72 in the central portion (at the center) in a plan view of the case member 72 (as seen from the −Y direction).

The pressing member 177 includes a flange portion 178 protruding to the outside in the diameter direction of the pressing member 177 in a disc shape from the position between the second electrode 82 and the first electrode 81 and having a diameter greater than that of the insertion hole 93E of the first electrode 81 and the insertion hole 94E of the second electrode 82.

In the pressing member 177, an end 177A, which is close to the bimetal plate 76, as a portion to be pressed towards the first electrode 81 (in the −Y direction) by the bimetal plate 76 deformed in the shape (the state shown in FIG. 4B) convex to the inside of the case member 72 is disposed between the bimetal plate 76 and the pin guide 80. The end 177A close to the bimetal plate 76 also serves as a portion pressing the bimetal plate 76 at the time of restoring the bimetal plate 76.

A surface 178A of the flange portion 178 facing the first electrode 81 (the −Y direction) serves as a portion pressing the first electrode 81 when the end 177A close to the bimetal plate 76 is pressed to move to the first electrode 81 (in the −Y direction) by the deformation of the bimetal plate 76 into the convex shape (the state shown in FIG. 4B).

A protruding portion (an end in the −Y direction) 177B protruding from the bottom wall 72C of the case member 72 to the outside (in the −Y direction) serves as a portion to be pressed towards the bimetal plate 76 from the outside of the case member 72 at the time of restoring the bimetal plate 76.

A surface 178B of the flange portion 178 facing the second electrode 82 (the Y direction) serves as a portion pressing the second electrode 82 to maintain the state where the first contact 91 and the second contact 92 are separated from each other at the time of restoring the bimetal plate 76. The pressing member 177 is formed of an insulating material, similarly to the case member 72.

According to the configuration of the first modification, when the protruding portion (the end in the −Y direction) 177B of the pressing member 177 is pressed towards the bimetal plate 76 (in the Y direction) from the outside of the case member 72 (the outside of the bottom wall 72C (form the −Y direction) at the time of restoring the bimetal plate 76, the pressing member 177 moves to the bimetal plate 76 (in the Y direction), and the bimetal plate 76 is pressed by the end 177A of the pressing member 177 close to the bimetal plate 76 and is restored into the concave shape.

At this time, the first electrode 81 pressed towards the bottom wall 72C (in the −Y direction) by the surface 178A of the flange portion 178 by the inversion of the bimetal plate 76 is restored to the original state and the first contact 91 moves towards the bimetal plate 76 (in the Y direction), when the pressing member 177 moves towards the bimetal plate 76 (in the Y direction). However, the movement is restricted by the spacer member 180. In addition, the second electrode 82 is pressed towards the bimetal plate 76 (in the Y direction) and is elastically deformed by the surface 178B of the flange portion 178 and thus the second contact 92 moves towards the bimetal plate 76 (in the Y direction). As a result, the state where the second contact 92 is separated from the first contact 91 is maintained.

When the pressing force (the external force) does not act on the pressing member 177 pressed towards the bimetal plate (in the Y direction) any more, the second electrode 82 elastically deformed is restored to the original state with its own elastic force and the second contact 92 thus comes into contact with the first contact 91 (see FIG. 7).

On the other hand, when the pressing member 177 is kept pressed towards the bimetal plate 76 (in the Y direction), the second electrode 82 is maintained in the elastically-deformed state and the state where the second contact 92 and the first contact 91 are separated from each other is maintained. Accordingly, the electrical circuit 25 is broken and the supply of power to the heat source 64B from the power supply unit 21 is continuously stopped.

In this way, the first modification has the same operation as in the above-mentioned exemplary embodiment. With a simple configuration like a single member of the pressing member 177, when the pressing member 177 is kept pressed towards the bimetal plate 76 (in the Y direction), the second electrode 82 is maintained in the elastically-deformed state and the state where the second contact 92 and the first contact 91 are separated from each other is maintained.

Second Modification

Figure 9A:
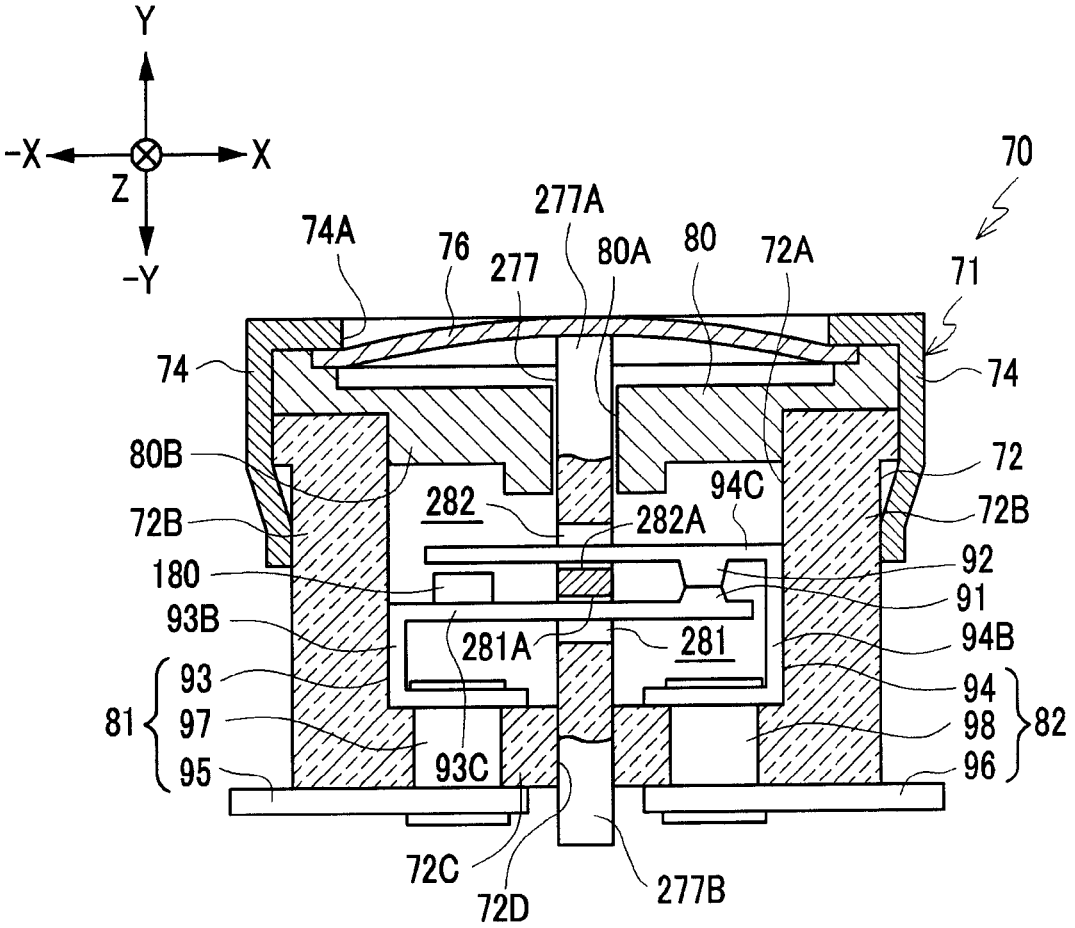
FIGS. 9A and 9B are diagrams schematically illustrating the configuration of a thermostat according to a second modification of the invention.
Figure 9B:
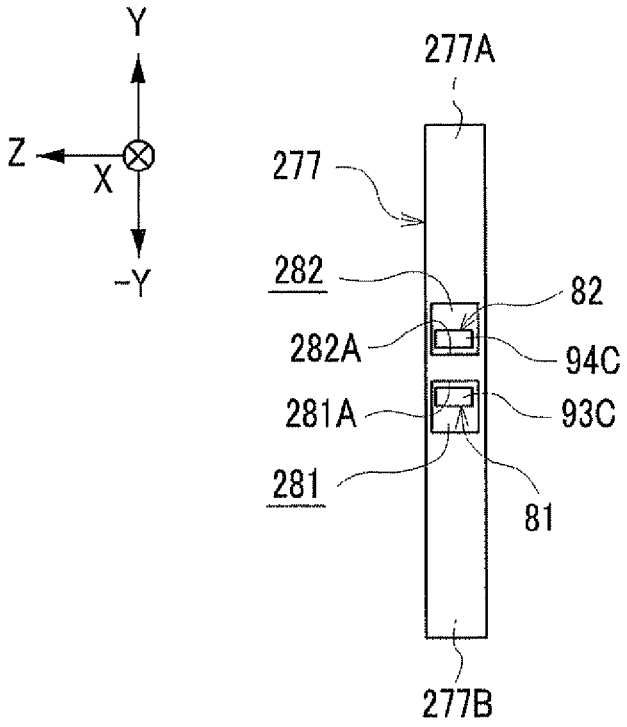

FIGS. 9A and 9B are diagrams illustrating the configuration of a second modification. Elements having the same functions as in the first modification are referenced by the same reference numerals and signs and the description thereof will not be repeated.

In the configuration of the second modification, as shown in FIGS. 9A and 9B, the insertion hole 93E in the first modification is not formed in the first electrode 81 and the insertion hole 94E in the first modification is not formed in the second electrode 82.

As shown in FIGS. 9A and 9B, a pressing member 277 according to the second modification has a length in the axial direction (in the Y direction) of the case member 72 and has a rod shape (for example, a cylinder shape). The pressing member 277 is inserted into the insertion hole 80A of the pin guide 80 and the insertion hole 72D of the bottom wall 72C of the case member 72 so as to be movable in the axial direction (in the −Y direction) of the case member 72 in the central portion (at the center) in a plan view of the case member 72 (as seen from the −Y direction).

In the pressing member 277, an insertion hole 282 into which the third portion 94C of the second electrode 82 is inserted is formed in the diameter direction (in the X direction) of the case member 72. In the pressing member 277, an insertion hole 281 into which the third portion 93C of the first electrode 81 is inserted is formed in the diameter direction (in the X direction) of the case member 72.

In the pressing member 277, an end 277A, which is close to the bimetal plate 76, as a portion to be pressed towards the first electrode 81 (in the −Y direction) by the bimetal plate 76 deformed in a shape (the state shown in FIG. 4B) convex to the inside of the case member 72 is disposed between the bimetal plate 76 and the pin guide 80. The end 277A close to the bimetal plate 76 also serves as portion pressing the bimetal plate 76 at the time of restoring the bimetal plate 76.

An inner wall surface 281A in the insertion hole 281 facing the bottom wall 72C (the −Y direction) of the case member 72 serves as a portion pressing the first electrode 81 when the end 277A close to the bimetal plate 76 is pressed to move to the first electrode 81 (in the −Y direction) by the deformation of the bimetal plate 76 into the convex shape (the state shown in FIG. 4B).

A protruding portion 277B (an end in the −Y direction) protruding from the bottom wall 72C of the case member 72 to the outside (in the −Y direction) serves as a portion to be pressed towards the bimetal plate 76 from the outside of the case member 72 at the time of restoring the bimetal plate 76.

An inner wall surface 282A in the insertion hole 282 facing the bimetal plate 76 (the Y direction) serves as a portion pressing the second electrode 82 to maintain the state where the first contact 91 and the second contact 92 are separated from each other at the time of restoring the bimetal plate 76. The pressing member 277 is formed of an insulating material, similarly to the case member 72.

According to the configuration of the second modification, when the protruding portion (the end in the −Y direction) 277B of the pressing member 277 is pressed towards the bimetal plate 76 (in the Y direction) from the outside of the case member 72 (the outside of the bottom wall 72C (from the −Y direction) at the time of restoring the bimetal plate 76, the pressing member 277 moves to the bimetal plate 76 (in the Y direction), and the bimetal plate 76 is pressed by the end 277A of the pressing member 277 close to the bimetal plate 76 and is restored into the concave shape.

At this time, the first electrode 81 pressed towards the bottom wall 72C (in the −Y direction) by the inner wall surface 281A in the insertion hole 281 by the inversion of the bimetal plate 76 is restored to the original state and the first contact 91 moves towards the bimetal plate 76 (in the Y direction), when the pressing member 277 moves towards the bimetal plate 76 (in the Y direction). However, the movement is restricted by the spacer member 180. In addition, the second electrode 82 is pressed towards the bimetal plate 76 (in the Y direction) and is elastically deformed by the inner wall surface 282A in the insertion hole 282 and thus the second contact 92 moves towards the bimetal plate 76 (in the Y direction). As a result, the state where the second contact 92 is separated from the first contact 91 is maintained.

When the pressing force (the external force) does not act on the pressing member 277 pressed towards the bimetal plate (in the Y direction) any more, the second electrode 82 elastically deformed is restored to the original state with its own elastic force and the second contact 92 thus comes into contact with the first contact 91 (see FIGS. 9A and 9B).

On the other hand, when the pressing member 277 is kept pressed towards the bimetal plate 76 (in the Y direction), the second electrode 82 is maintained in the elastically-deformed state and the state where the second contact 92 and the first contact 91 are separated from each other is maintained. Accordingly, the electrical circuit 25 is broken and the supply of power to the heat source 64B from the power supply unit 21 is continuously stopped.

In this way, the second modification has the same operation as in the above-mentioned exemplary embodiment. With a simple configuration like a single member of the pressing member 277, when the pressing member 277 is kept pressed towards the bimetal plate 76 (in the Y direction), the second electrode 82 is maintained in the elastically-deformed state and the state where the second contact 92 and the first contact 91 are separated from each other is maintained.

Figure 10A:
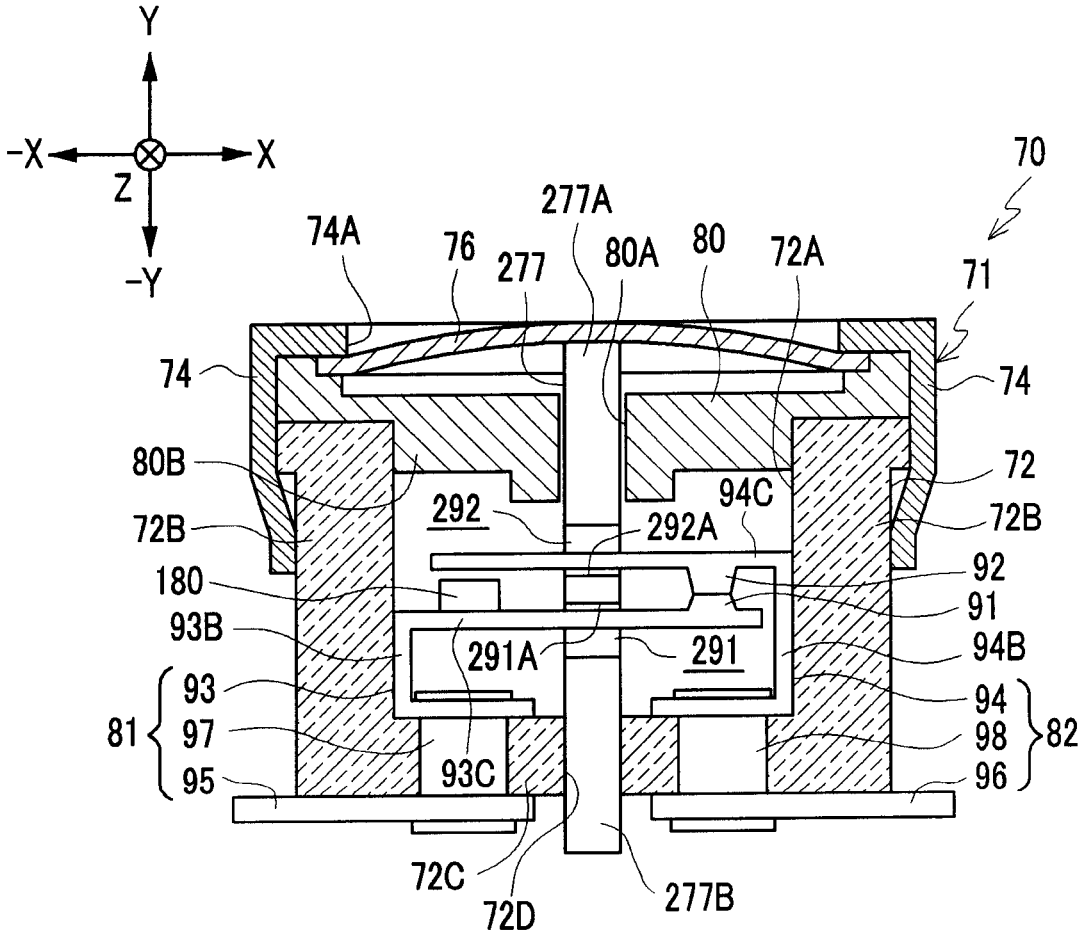
FIGS. 10A and 10B are diagrams schematically illustrating an example where an insertion groove is formed instead of an insertion hole in the configuration of the thermostat according to the second modification.
Figure 10B:
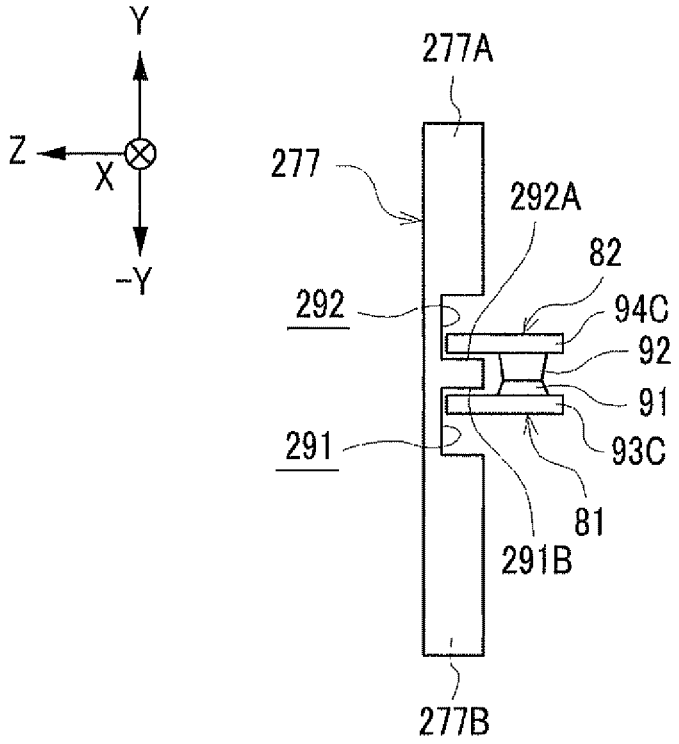

As shown in FIGS. 10A and 10B, the pressing member 277 may include an insertion groove 292 into which the third portion 94C of the second electrode 82 is inserted instead of the insertion hole 282. The pressing member 277 may have an insertion groove 291 into which the third portion 93C of the first electrode 81 is inserted instead of the insertion hole 281.

In this configuration, an inner wall surface 291A in the insertion groove 291 facing the bottom wall 72C (the −Y direction) of the case member 72 serves as a portion pressing the first electrode 81 when the end 277A close to the bimetal plate 76 is pressed to move to the first electrode 81 (in the −Y direction) by the deformation of the bimetal plate 76 into the convex shape (the state shown in FIG. 4B).

An inner wall surface 292A in the insertion groove 292 facing the bimetal plate 76 (the Y direction) serves as a portion pressing the second electrode 82 to maintain the state where the first contact 91 and the second contact 92 are separated from each other at the time of restoring the bimetal plate 76.

The invention is not limited to the above-mentioned exemplary embodiment, but may be modified, changed, and improved in various forms. For example, the above-mentioned modifications may be appropriately combined.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A heat-responsive switch comprising:

a case member;

a deformation member that is supported by the case member in a shape concave to an inside of the case member and that is deformed in a shape convex to an inside of the case member in response to a temperature variation;

a first electrode that has a first contact disposed inside the case member;

a second electrode that has a second contact disposed between the deformation member and the first electrode and that brings the second contact into contact with the first contact in a state where the first contact is impelled to the deformation member;

a first pressing member that is disposed to extend to the first electrode from between the deformation member and the second electrode and that presses the first electrode to separate the first contact from the second contact by having an end thereof pressed by the deformation of the deformation member into the convex shape; and a second pressing member of which an end protrudes from the case member in a state where the deformation member is deformed and that presses the deformation member to restore the deformation member to the concave shape and presses and elastically deforms the second electrode to keep the first contact and the second contact separated from each other by having the end pressed to the deformation member from an outside of the case member, wherein the first pressing member includes a first surface and a second surface disposed between the first electrode and the deformation member, the first surface is formed at an end close to the first electrode and presses the first electrode by having an end portion thereof, which is close to the deformation member, pressed by the deformation of the deformation member into the convex shape, and the second surface is formed closer to the deformation member than the first surface so as to face the second electrode, and wherein the second pressing member is disposed to extend from the end of the first pressing member close to the first electrode to the outside of the case member in the direction opposite to the deformation member, presses the second electrode to keep the first contract and the second contact separated from each other by being pressed to the deformation member from the outside of the case member, and presses the deformation member to restore the deformation member to the concave shape by pressing the second surface with the second electrode interposed therebetween.

2. The heat-responsive switch according to claim 1, wherein the first pressing member and the second pressing member are incorporated in a body.

3. A fixing device fixing an image onto a recording medium, the fixing device comprising:

a heating member that heats the image formed on the recording medium;

a circuit that supplies power to the heating member; and the heat-responsive switch according to claim 1 in which the first electrode and the second electrode are disposed in the circuit and the deformation member is deformed in response to the temperature variation due to radiant heat emitted from the heating member so that the first contact and the second contact are separated from each other to break the circuit.

4. An image forming apparatus comprising:

an image forming unit that forms an image on a recording medium; and the fixing device according to claim 3 that fixes the image formed by the image forming unit onto the recording medium.

5. A heat-responsive switch comprising:

a case member;

a deformation member that is supported by the case member in a shape concave to an inside of the case member and that is deformed in a shape convex to an inside of the case member in response to a temperature variation;

a first electrode that has a first contact disposed inside the case member;

a second electrode that has a second contact disposed between the deformation member and the first electrode and that brings the second contact into contact with the first contact in a state where the first contact is impelled to the deformation member;

a first pressing member that is disposed to extend to the first electrode from between the deformation member and the second electrode and that presses the first electrode to separate the first contact from the second contact by having an end thereof pressed by the deformation of the deformation member into the convex shape; and a second pressing member of which an end protrudes from the case member in a state where the deformation member is deformed and that presses the deformation member to restore the deformation member to the concave shape and presses and elastically deforms the second electrode to keep the first contact and the second contact separated from each other by having the end pressed to the deformation member from an outside of the case member, wherein, when the second pressing member is pressed toward the deformation member from the outside of the case member, the second pressing member does not press the first electrode toward the second electrode.

* * * * *